US011903506B2

(12) United States Patent
Zhao

(10) Patent No.: US 11,903,506 B2
(45) Date of Patent: Feb. 20, 2024

(54) CHRISTMAS TREE STAND AND ASSEMBLED SUPPORT ASSEMBLY

(71) Applicant: NINGBO FLYING-HORSE INTERNATIONAL TRADE CO., LTD, Ningbo (CN)

(72) Inventor: Honghua Zhao, Ningbo (CN)

(73) Assignee: NINGBO FLYING-HORSE INTERNATIONAL TRADE CO., LTD, Ningbo (CN)

( * ) Notice: Subject to any disclaimer, the term of this patent is extended or adjusted under 35 U.S.C. 154(b) by 0 days.

(21) Appl. No.: 17/982,551

(22) Filed: Nov. 8, 2022

(65) Prior Publication Data

US 2023/0066977 A1 Mar. 2, 2023

(30) Foreign Application Priority Data

Aug. 17, 2022 (CN) ..... 202222173812.9

(51) Int. Cl.
*A47G 33/12* (2006.01)

(52) U.S. Cl.
CPC ..... *A47G 33/1226* (2013.01)

(58) Field of Classification Search
CPC ..... A47G 33/12; A47G 2033/1286; F16M 11/22; F16M 2200/08
USPC ..... 248/158, 161, 404, 412, 157, 420, 248/229.13, 229.23, 231.51, 316, 5, 525; 47/42, 40.5
See application file for complete search history.

(56) References Cited

U.S. PATENT DOCUMENTS

| | | | | | |
|---|---|---|---|---|---|
| 1,895,717 | A * | 1/1933 | Kelley | A47G 33/12 | D11/182 |
| 4,406,437 | A * | 9/1983 | Wright | F16M 11/22 | 248/188.7 |
| 4,712,758 | A * | 12/1987 | Cuschera | F16M 11/42 | 248/188.7 |
| 4,763,866 | A * | 8/1988 | Sinchok | A47F 5/04 | 248/188.7 |
| 5,938,168 | A * | 8/1999 | Adams | A47G 33/12 | 248/524 |
| 6,293,512 | B1 * | 9/2001 | Ho | F16M 11/22 | 248/407 |
| 8,215,603 | B2 * | 7/2012 | Puleo | A47G 33/12 | 248/528 |
| 2010/0044545 | A1 | 2/2010 | Hackney | | |
| 2018/0110353 | A1 | 4/2018 | Wach | | |
| 2020/0352379 | A1 | 11/2020 | Fiveash | | |

* cited by examiner

*Primary Examiner* — Muhammad Ijaz

(57) ABSTRACT

The disclosure relates to a Christmas tree stand and an assembled support assembly, where the Christmas tree stand comprises a tree stand support assembly and a connector, the tree stand support assembly is formed by assembling a number of tree stand members with each other, and enables the tree stand members to be self-shaped after assembly without using other tools by means of an inside assembly structure, thereby facilitating assembly of the Christmas tree stand, and the split type tree stand members are also advantageous in packaging and transportation after disassembly.

20 Claims, 16 Drawing Sheets

CHRISTMAS TREE STAND AND ASSEMBLED SUPPORT ASSEMBLY

TECHNICAL FIELD

The disclosure relates to the field of festival decoration supplies, and specifically relates to a Christmas tree stand for use in Christmas decoration and an assembled support assembly that can be used to support load-bearing components such as the Christmas tree stand.

BACKGROUND

Christmas is a traditional festival, and using Christmas trees for festival decoration during Christmas is a traditional custom. Christmas trees are divided into two main categories, namely real trees and artificial trees, the real trees are trees of the Abies of Pinaceae, and the artificial trees are made by means of artificial synthesis, and both the real trees and the artificial trees need to be fixed by Christmas tree stands.

A traditional Christmas tree stand has a bottom surface either in a planar structure or in a multi-fulcrum structure. The Christmas tree stand having a planar bottom surface has a large contact area with the ground and is relatively stable, but is liable to shake when the ground is poorly flat. A Christmas tree stand with a fulcrum-like bottom surface structure has three or more fulcrums to make contact with the ground, has better compatibility with uneven ground with respect to the tree stand with a planar bottom surface, and can be stably placed on the ground by adjusting position and angle, but is inconvenient to place, and a vacant center of the bottom surface thereof results in increased structural strength requirement for each leg.

SUMMARY

It is an object of the disclosure to provide a cross Christmas tree stand with stable force bearing and smooth placement, and an assembled support assembly that can be used to support load-bearing components such as the Christmas tree stand.

As a first aspect of the disclosure, provided is a Christmas tree stand which comprises a tree stand support assembly and a connector for bearing a Christmas tree. The tree stand support assembly is formed by at least three tree stand members, the tree stand members are assembled with each other at an inner end thereof by an assembly portion so as to form the tree stand support assembly, and two rotation limiting members fitting with each other are provided on the assembly portion so as to limit relative rotation between the two tree stand members by mutual fit of the first rotation limiting member and the second rotation limiting member; and an upper and lower limiting mechanism is provided between two adjacent tree stand members, or between one tree stand member and the other tree stand members to limit in an up and down direction, so that the tree stand members are limited in the up and down direction, and the tree stand members are assembled and shaped.

By the rotation limiting members and the upper and lower limiting member, the tree stand members can be self-shaped after assembly without using other tools or adhesives, thereby facilitating assembly of the Christmas tree stand; at the same time, the split type tree stand members also facilitate packaging and transportation after disassembly, which is beneficial to reducing length and volume of the package.

As a second aspect of the disclosure, there is also provided a Christmas tree stand which also comprises a tree stand support assembly and a connector, the structure of the tree stand members for constituting the tree stand support assembly is similar to those of the above-mentioned Christmas tree stand, in which the number of the tree stand members is an even number, two tree stand members are considered as a group to form a support member, and at least two support members cross each other at a middle portion to form the tree stand support assembly. Thus, in the Christmas tree stand, the number of the tree stand members is 4, 6, 8 or more.

In addition, the Christmas tree stand is further formed with a second support portion located at an intersection point and a first support portion located on an outside. When the Christmas tree is not borne, the second support portion is suspended without bearing any force, and only the first support portion bears a force. After the Christmas tree is placed, the tree stand support assembly is deformed so that the second support portion is in contact with a support surface, and since it is located near directly below a Christmas tree, major weight of the Christmas tree is borne by the second support portion, the first support portion mainly serves as an auxiliary stabilizing role and a minor load-bearing role.

The above-mentioned deformation of the tree stand support assembly is caused by two reasons, one is that the tree stand members fit with each other at the assembly portions, so that there is an assembly gap between each other, and when bearing a vertical acting force, the deformation will be relatively obvious; the second is from a shape and material of each tree stand members; since an inner end of each tree stand member is only slightly concave relative to an outer end thereof, and a vertical distance thereof is 0.2-2 cm, a small weight can deform the tree stand support assembly and cause the second support portion to bear the force.

As a third aspect of the disclosure, we also provide an assembled support assembly for use in the Christmas tree stand or similar load-bearing components as described above to play a support role. The similar load-bearing components may be living facilities such as flowerpots.

The Christmas tree stand and the assembled support assemblies of the disclosure have the following beneficial effects:

1. The Christmas tree stand comprises a second support portion located below the connector and used for bearing the Christmas tree, and a first support portion located outside the second support portion, the first support portion is in contact with the support surface to bear the force without external force, and the second support portion is suspended without bearing any force; and after the Christmas tree is fixed in the tree stand, the second support portion is deformed to be displaced downwards to get contact with the support surface to bear most of the weight of the Christmas tree, and the first support portion plays a stabilizing role and bears a small weight.
2. The Christmas tree stand having the above-mentioned structure are more stable in fixing the Christmas tree than two existing tree stands in which the second support portion always does not bear the acting force, and in which both the second support portion and the first support portion always bear the acting force.
3. The deformation of the second support portion of the Christmas tree stand is mainly provided by relative deformation between the assembly portions at the tree stand member inner ends formed by the assembly; on the basis of the same material and size, the Christmas tree stand has a greater deformation amplitude, so that the material and structural requirements can be reduced, and the role of the Christmas tree stand can be better played.

4. The tree stand support assembly of the Christmas tree stand is formed by assembly, which can reduce the packaging and transportation volume and reduce the cost. Moreover, the Christmas tree stand can be conveniently assembled, and the structure is firm after assembly.
5. The tree stand support assembly can be adapted to real trees and artificial trees by using different connectors, which can improve the versatility of parts and enrich the diversity of products.
6. The tree stand support assembly can also be shaped after self-assembly to form a pre-assembly with preliminary self-retention, and can be easily taken, moved and assembled during subsequent assembly, resulting in convenient operation.

Figure 1:
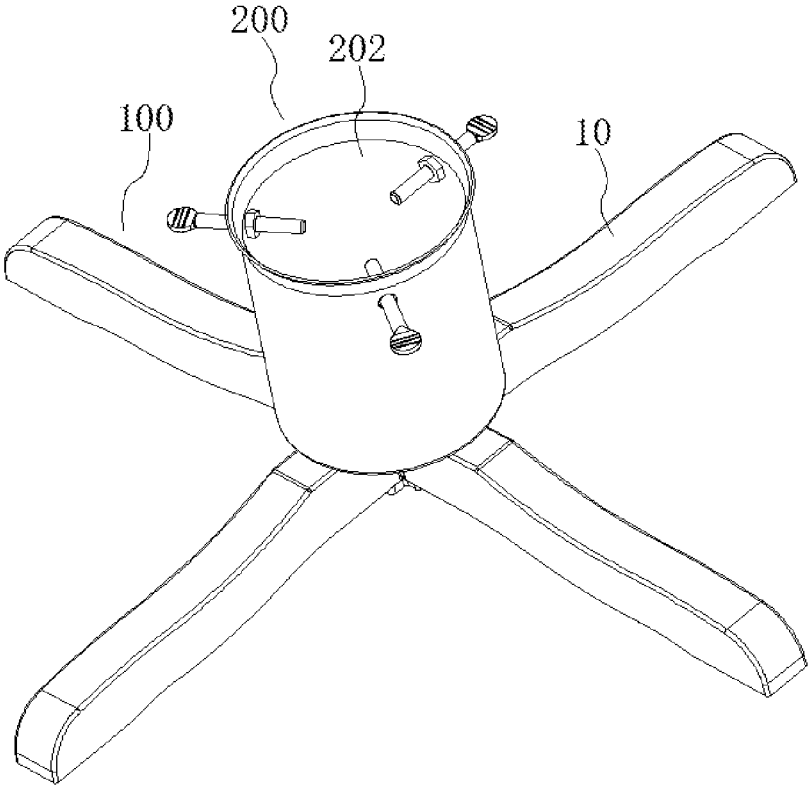
FIG. 1 is a schematic structural view of a cross Christmas tree stand according to Embodiment 1 of the disclosure.

In the drawings, 100. tree stand support assembly, 200. connector, 10. tree stand member, 11. first tree stand member, 12. first tree stand member, 13. first tree stand member, 14. first tree stand member, 15. fastener, 101 first support portion, 109. second support portion, 104. through hole, 105. clamping convex, 106 clamping concave, 107. moving wheel, 108. second snap connection portion, 111. first assembly portion, 121. second assembly portion, 131. third assembly portion, 141. fourth assembly portion, 142 clamping portion, 143. first snap connection portion, 112. nut concave position, 113. nut cavity, 114. secondary cavity, 201. first bearing cylinder, 202. bearing cavity, 203. second nut, 204. adjusting member, 205. first nut, 206. welding portion, 210. second bearing cylinder, and 211. covering member.

DESCRIPTION OF THE EMBODIMENTS

A cross Christmas tree stand comprises a tree stand support assembly 100, the tree stand support assembly 100 comprises at least two support members, the support members cross each other at a middle portion to form the tree stand support assembly 100.

A second support portion 109 is formed at an intersection of the support members, and a first support portion 101 is formed on at least one of the support members and outside the intersection. The first support portion 101 is configured to get contact with a support surface to provide a load bearing force or stabilizing force, and the second support portion 109 provides a load bearing force when in contact with the support surface.

In an initial condition, the first support portion 101 is in contact with the support surface so as to bear a force, and the second support portion 109 is suspended without contact with the support surface; after a Christmas tree is fixed into the cross Christmas tree stand, the second support portion 109 is in contact with the support surface so as to bear a force, the force borne by the second support portion 109 is far greater than that borne by the first support portion 101, so that weight of the Christmas tree is mainly borne by the second support portion 109, and the first support portion 101 mainly plays a stabilizing role to assist in providing a small support force.

In a preferred embodiment, at least one support member is formed by assembling two tree stand members 10. The tree stand member 10 comprises a tree stand member outer end, a tree stand member middle section and a tree stand member inner end, and the tree stand members 10 are assembled with each other at the tree stand member inner ends to form the tree stand support assembly 100. An assembly portion is provided at the tree stand member inner end of each of the tree stand members 10, a through hole 104 is provided on the assembly portion, a fastener 15 passes through the through holes 104 of the tree stand members 10 in turn to fix the tree stand support assembly 100, and the second support portion 109 is formed on the assembly portion on a bottom layer or on the fastener 15.

In some other embodiments, the cross Christmas tree stand further comprises a connector 200, moreover, all the support members are formed by assembling two tree stand members 10 with each other at the intersection, and the assembly portions of the tree stand members 10 are sequentially arranged from top to bottom and are passed through by the fastener 15 so as to be fixed to the connector 200 to form the cross Christmas tree stand.

A tree stand support assembly having a same structure as the tree stand support assembly 100 in the cross Christmas tree stand described above, but not limited to having the corresponding structure and function of the second support portion 109.

A Christmas tree stand consisting of the tree stand support assembly and the connector 200 described above.

Embodiment 1

As shown in FIGS. 1-17, the shown is a cross Christmas tree stand for fixing a Christmas tree therein for festival decoration during Christmas. The Christmas tree stand is mainly adapted to a real Christmas tree made of a fir tree.

As shown in FIG. 1, the Christmas tree stand comprises a tree stand support assembly 100 and a connector 200 fixed thereto.

Figure 2:
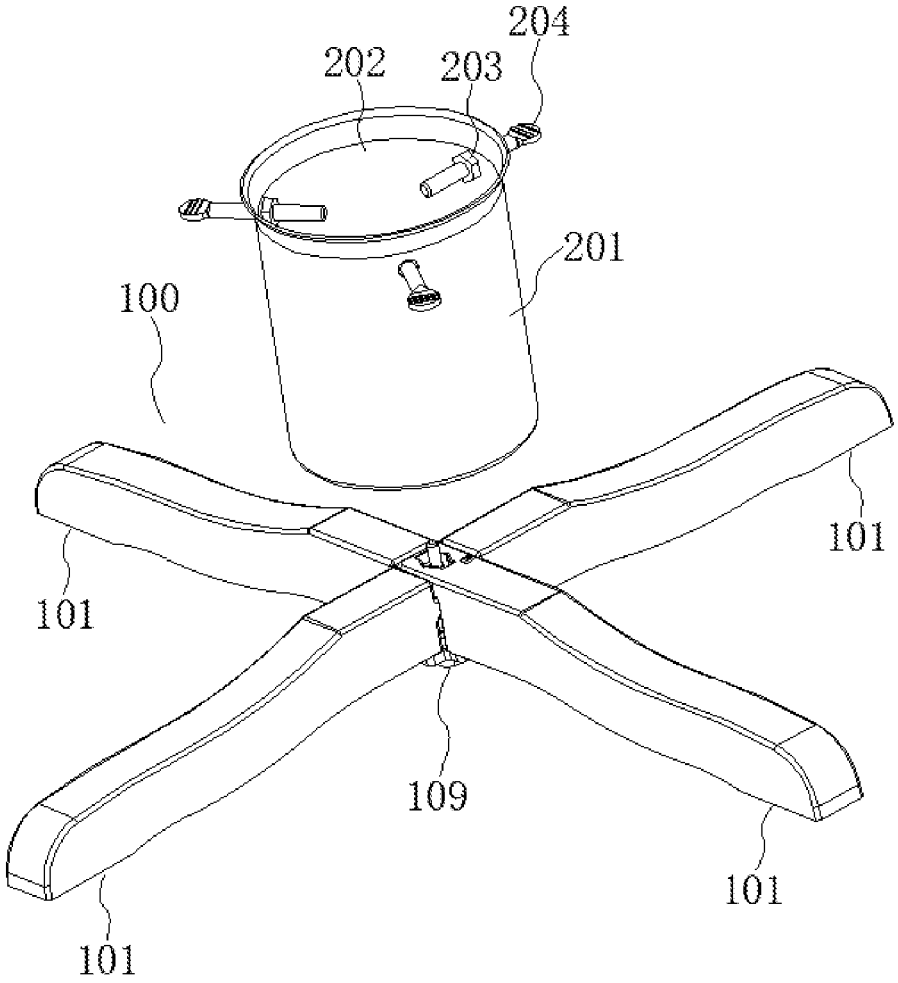
FIG. 2 is a structural exploded view of the embodiment of FIG. 1.

As shown in FIG. 2, the connector 200 comprises a first bearing cylinder 201, an interior of the first bearing cylinder 201 is hollow so as to form a bearing cavity 202 for accommodating a Christmas tree, a number of through holes are provided at an upper portion of the bearing cavity 202, a second nut 203 is welded on an inner wall at the through holes, an adjusting member 204 is provided with an external thread (not shown in the FIG.), and the adjusting member 204 and the second nut 203 are in thread fit, so that a front end of the adjusting member 204 is screwed in or out of the bearing cavity 202 by rotating the adjusting member, thereby adjusting a distance between the front ends of the adjusting members 204 to adapt to different sizes of Christmas trees. After the Christmas tree is placed in the bearing cavity 202, a bottom surface is supported by a bottom wall of the bearing cavity 202, and the front end of the adjusting member 204 abuts against a trunk of the Christmas tree to fix the Christmas tree.

Figure 3:
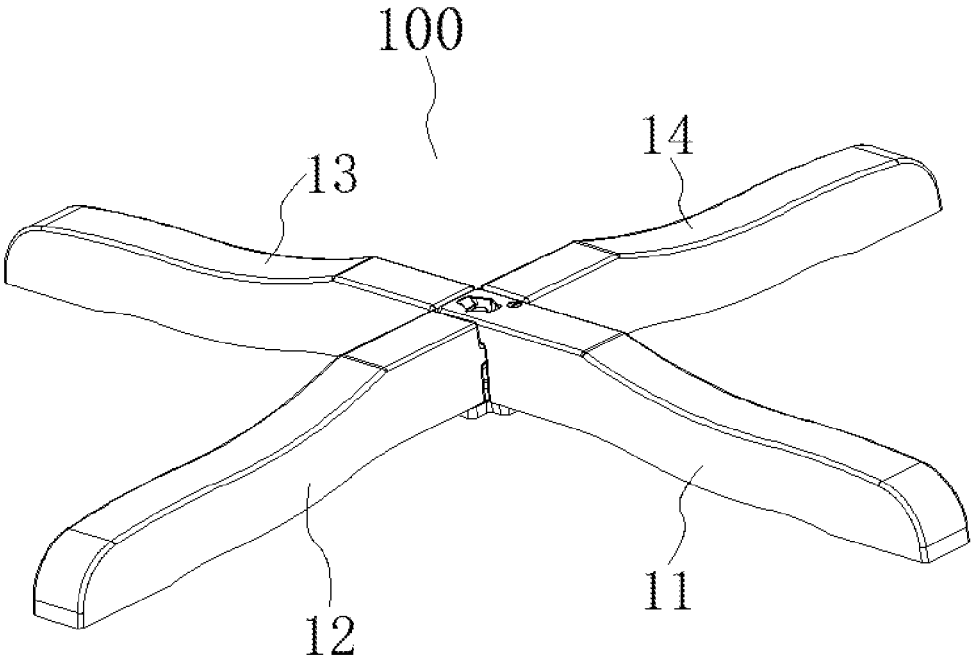
FIG. 3 is a schematic structural view of a tree stand support assembly in the embodiment of FIG. 1.

As shown in FIG. 3, in the embodiment, the tree stand support assembly 100 comprises two sets of support members which cross with each other at a middle portion to form a cross tree stand support assembly. Each set of support members is formed by assembling two tree stand members 10 in a head-to-head manner. Of course, it may also be an entire support member.

In this embodiment, each set of support members is formed by assembling two tree stand members 10 together. That is, a first tree stand member 11 and a third tree stand member 13, and a second tree stand member 12 and a fourth tree stand member 14 are respectively assembled head-to-head to form the cross tree stand support assembly as shown in FIG. 3.

Figure 4:
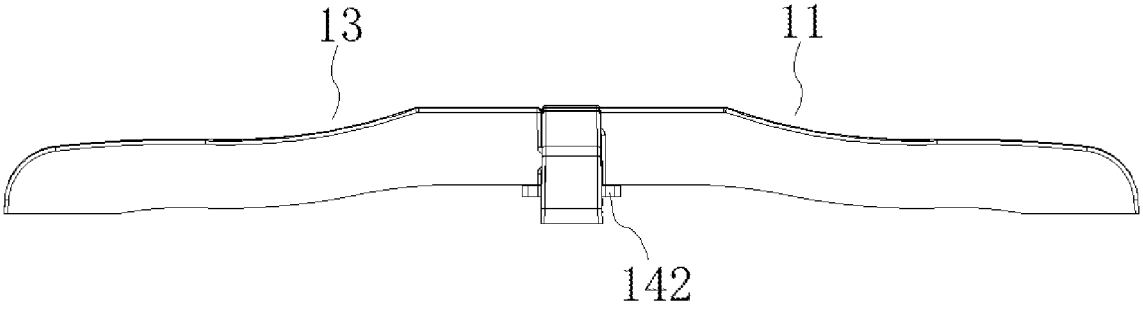
FIG. 4 is a front view of FIG. 3.
Figure 5:
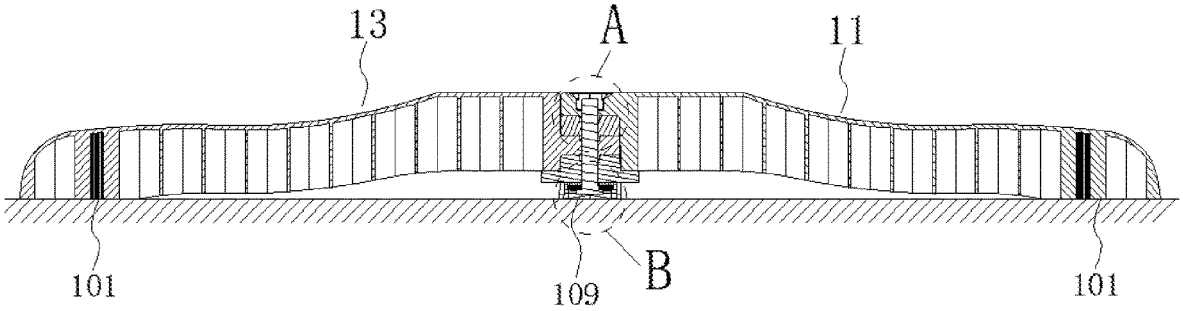
FIG. 5 is a sectional view of FIG. 4.

As shown in FIGS. 4 and 5, a first support portion 101 for getting contact with a surface providing a support force, i.e., a support surface (e.g. a ground), is formed at an outside of the tree stand support assembly, and the first support portions 101 are formed at both ends of each set of support members.

A second support portion 109 is also formed at or near an intersection of two sets of support members, and the second support portion 109 is not initially in contact with the support surface.

In this embodiment, the second support portion 109 is located below the connector 200. Most preferably, the second support portion 109 is disposed directly below the intersection of two sets of support members, i.e., below a center of the connector 200.

Figure 7:
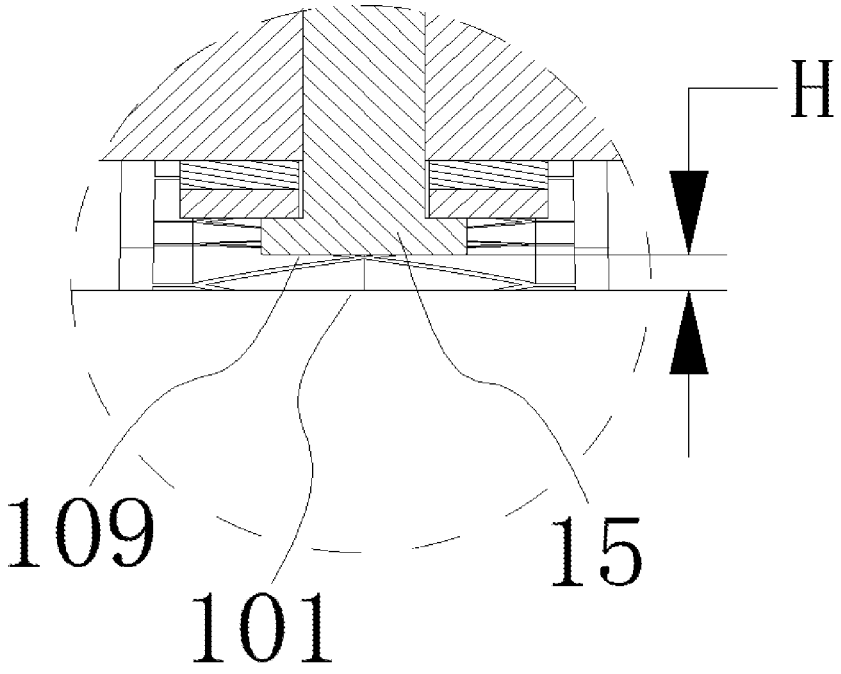
FIG. 7 is a partially schematic enlarged view of B in FIG. 5.

As shown in FIG. 7, a fastener 15 for fixing the tree stand support assembly 100 to the connector 200 is provided protruding from a lower surface of the tree stand support assembly 100, and a lower surface of the fastener 15 is formed as the second support portion 109. Of course, in other embodiments, if a bottom surface of the tree stand support assembly 100 is provided with a concave position for the fastener 15 to be fully accommodated therein, the second support portion 109 may be formed from the bottom surface of the tree stand support assembly 100, i.e., from the tree stand support assembly 100 below the intersection.

In this embodiment, a gap between the second support portion 109 and the support surface (e.g., the ground) is 0.2-2 cm. In an initial condition, the Christmas tree stand is assembled but the Christmas tree is not placed therein, and at this time, the first support portion 101 is in contact with the support surface to provide a support force, and the second support portion 109 is suspended without contact with the support surface. When the Christmas tree is fixed therein, weight of the Christmas tree acts on the support member, causing it to deform slightly, the second support portion 109 is in contact with the support surface to provide most of the support force, and the first support portion 101 provides only a small amount of the support force, and mainly plays a stabilizing role.

That is, the weight of the Christmas tree stand of the disclosure is mainly borne by the second support portion 109 after the Christmas tree is placed therein, and the first support portion 101 plays an auxiliary and stabilizing role.

In the process, the above-mentioned deformation causes the second support portion 109 to change from being suspended to bear the force, mainly because each support member is formed by assembling two tree stand members 10 head-to-head, there is an assembly gap at the assembling position, and when bearing a vertical acting force, a greater amount of deformation is generated at a joint of two tree stand members with respect to the whole support member, so that the second support portion 109 is in contact with the support surface.

Of course, in other embodiments, when the support member is formed of a single-piece material, structural strength at the intersection may be weakened by thinning the intersection, or the support member may be formed of a relatively more flexible material to achieve the same purpose, but material selection and processing thereof are significantly more difficult than the assembled structure described above.

Figure 8:
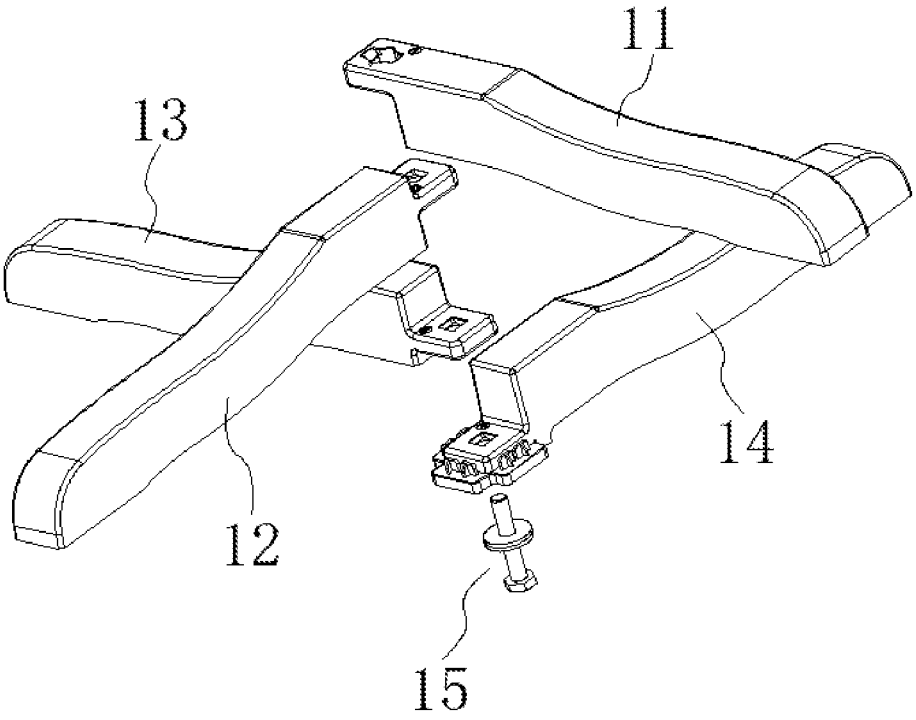
FIG. 8 is a structural exploded view of FIG. 3.

As shown in FIG. 8, the tree stand support assembly 100 is formed by assembling four tree stand members 10 with each other, and comprises a first tree stand member 11, a first tree stand member 12, a first tree stand member 13 and a first tree stand member 14, and a fastener 15 passes through the tree stand members in turn and is fitted to a first bearing cylinder 201. Each tree stand member 10 is formed by a tree stand member outer end, a tree stand member middle section, and a tree stand inner end respectively.

Both the tree stand member outer end and the tree stand member inner end are straight, and the tree stand member middle section is slightly curved so that the tree stand member inner end is arranged slightly higher than the tree stand member outer end, so that the second support portion 109 is suspended in an initial condition.

As shown in FIGS. 9-15, the inner end of the first tree stand member 11 is provided with a first assembly portion 111, the inner end of the first tree stand member 12 is provided with a second assembly portion 121, the inner end of the first tree stand member 13 is provided with a third assembly portion 131, the inner end of the first tree stand member 14 is provided with a fourth assembly portion 141, and the first assembly portion 111, the second assembly portion 121, the third assembly portion 131 and the fourth assembly portion 141 are sequentially arranged from top to bottom.

In this embodiment, the first assembly portion 111 of the first tree stand member 11 is located at its ¼ height position, the second assembly portion 121 of the first tree stand member 12 is located at its ⅔ height position, the third assembly portion 131 of the first tree stand member 13 is located at its ¾ height position, and the fourth assembly portion 141 of the first tree stand member 14 is located at its 4/4 height position.

In other embodiments, the number of the tree stand members 10 may be 3, 5, 6 or more, and when the number of the tree stand members 10 is changed from 4 in Embodiment 1 or Embodiment 2 to 3, 5 or 6, the thickness of the assembly portions should be changed accordingly, from about ¼ of the height of the tree stand members 10 in Embodiment 1 or Embodiment 2 to ⅓, ⅕ or ⅙. Preferably, the tree stand members 10 are uniformly arranged in a circumferential direction, that is, 3 tree stand members are arranged at 120° to each other, and 4 tree stand members are arranged at 90° to each other. Further, in other embodiments, the thickness of the assembly portions may be unequal.

The tree stand members 10 of this embodiment are further marked with a numbered numeral respectively for ease of mounting, and are numbered from top to bottom.

In this embodiment, the thickness of the assembly portions is substantially equal, and a total height of the assembly portions after they are stacked on top of each other is substantially equal to the height of the tree stand member 10. Therefore, the thickness of each of the assembly portions is about ¼ of the height of the tree stand member 10. Each of the assembly portions is provided with a through hole 104 therethrough for a fastener 105 to pass therethrough.

In this embodiment, in addition to the through hole 104 provided in the assembly portions at the tree stand member inner ends, a clamping structure is provided between two adjacent assembly portions, and comprises two components respectively provided on two assembly portions, and the two clamping components fit with each other to facilitate the assembly of the tree stand support assembly 100 after preliminary clamping between the two adjacent assembly portions.

As shown in FIGS. 9-15, a lower surface of the first tree stand member 11 is convexly provided with a clamping convex 105, and the through hole 104 is arranged on the clamping convex 105. A upper surface of the first tree stand member 12 is concavely provided with a clamping concave 106, a lower surface thereof is convexly provided with a clamping convex 105, the clamping concave 106 and the clamping convex 105 are arranged correspondingly up and down, and the through hole 104 is arranged on both; and the first tree stand member 13 has the same clamping concave 106 and clamping convex 105 as the first tree stand member 12. A upper surface of the first tree stand member 14 is concavely provided with a clamping concave 106. When the tree stand members 10 are assembled with each other, the clamping convex 105 of the first tree stand member 11 is fitted into the clamping concave 106 of the first tree stand member 12, the clamping convex 105 of the second tree stand member 12 is fitted into the clamping concave 106 of the third tree stand 13, the clamping convex 105 of the third tree stand 13 is fitted into the clamping concave 106 of the fourth tree stand 14, and the through holes 104 are respectively arranged through up and down.

Figure 6:
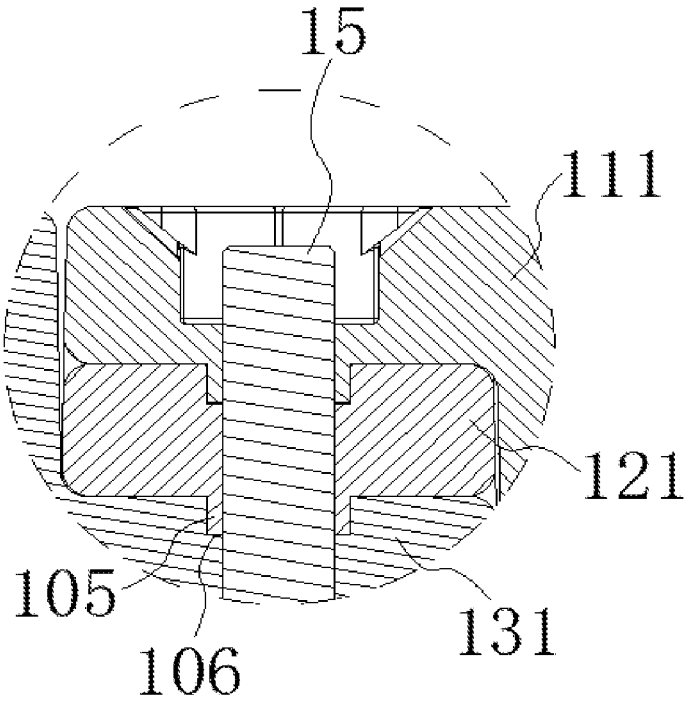
FIG. 6 is a partially schematic enlarged view of A in FIG. 5.

As shown in FIG. 6, when the assembly portions of the tree stand members 10 are sequentially stacked, the clamping convexes 105 and the clamping concaves 106 of the adjacent tree stand members 10 concavely and convexly fit for positioning and rotation.

In this embodiment, the clamping concave 106 and the clamping convex 105 have a square outer contour respectively, so that each tree stand member 10 is fixed at a relative angle after being fitted up and down, and cannot move arbitrarily. Of course, other non-circular geometric shapes than square shape may achieve the same effect, such as triangle, pentagon and hexagon.

In this embodiment, the clamping convex 105 and the clamping concave 106 are in interference fit, that is, the outer contour of the clamping convex 105 is slightly larger than an inner contour of the clamping concave 106, so that the tree stand members 10 can be preliminarily assembled together to form a cross structure under the action of an appropriate external force. Subsequent mounting only requires fixing the whole to the first bearing cylinder 201 by means of the fastener 15, and does not require mounting the tree stand members one by one.

In other embodiments, the preliminary assembling and fixing between the tree stand members 10 may be performed by other quick-release structures, for example, two tree stand members 10 are provided with males and females respectively on the assembly portions thereof to be engaged with each other.

Figure 15:
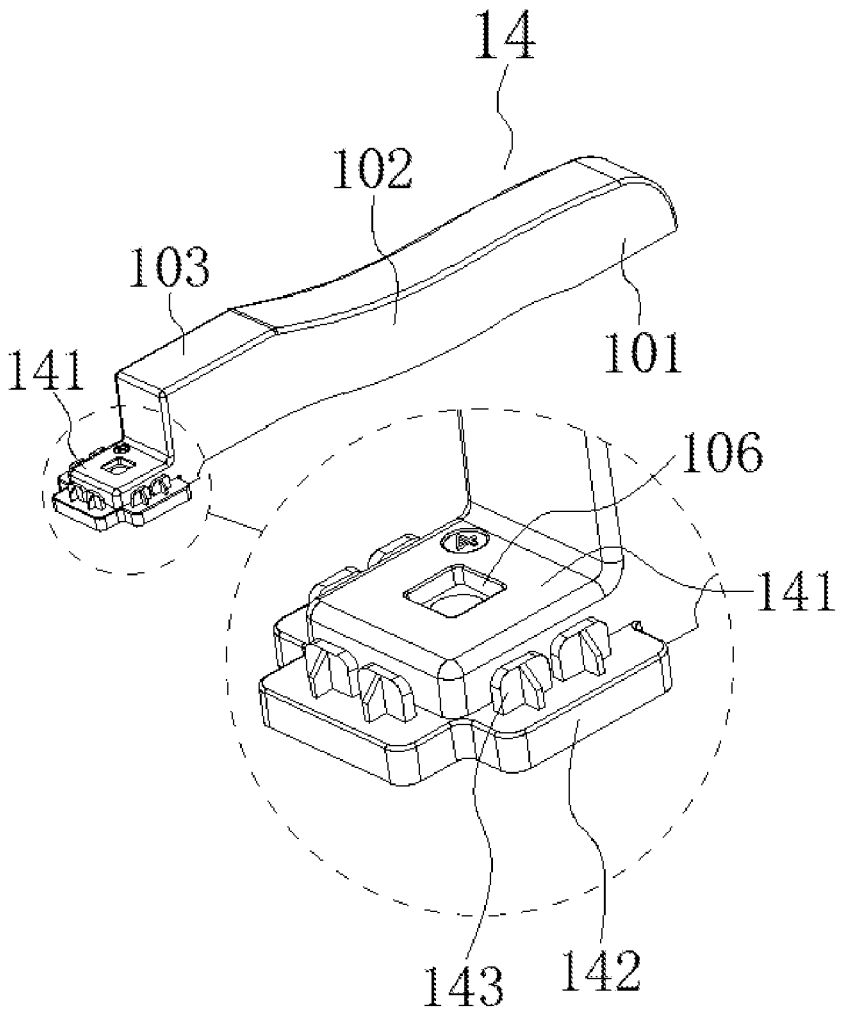
FIG. 15 is a schematic structural top view of a fourth tree stand member in FIG. 3 and a partially schematic enlarged view thereof.
Figure 16:
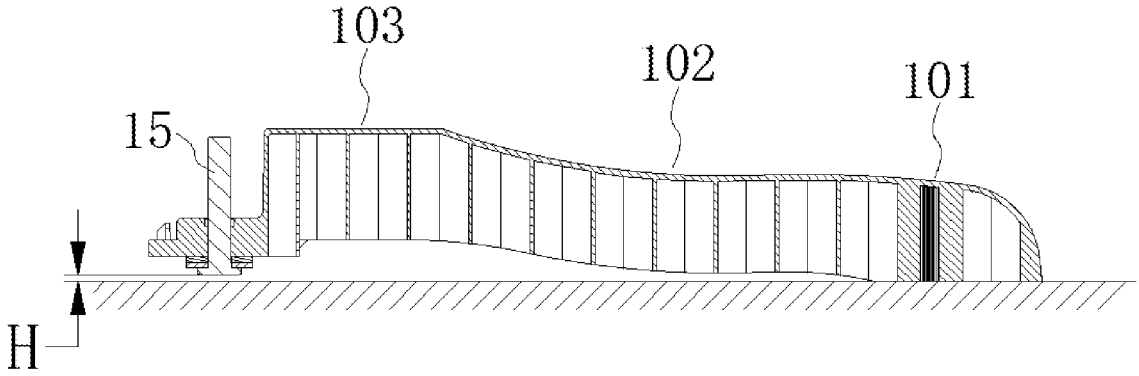
FIG. 16 is a sectional view of fit between the fourth tree stand member and a fastener in the embodiment of FIG. 1.

As shown in FIG. 15, in this embodiment, a clamping portion 142 is further formed in three outside directions of the fourth assembly portion 141, a first snap connection portion 143 is provided on the clamping portion 142, and a second snap connection portion 108 is correspondingly provided on a bottom surface of the inner end of each tree stand support member 10. After the tree stand members 10 are assembled with each other, each first snap connection portion 143 is fitted into a corresponding second snap connection portion 108, and the first snap connection portion 143 and the second snap connection portion 108 fit with each other by interference fit or other snap structures, so as to fix the first tree stand member 11, the first tree stand member 12 and the first tree stand 13 relative to the first tree stand member 14 in the up and down direction, so that the four tree stand members themselves can form a relatively stable assembly structure.

In this embodiment, the tree stand member inner ends 103 are further arranged to be placed on the clamping portion 142 respectively such that both the tree stand member outer end 101 and the tree stand member inner end 103 may get contact with a support surface (e.g., the ground) to provide a support force. The tree stand member outer end 101 is generally in direct contact with the support surface, while the tree stand member inner end 103 is in contact with the support surface via the clamping portion 142, so that the weight at a center of the tree stand support assembly is not directly borne by the assembly portions 111, 121, 131 and 141, but the tree stand member inner end 103 provides the main support force, thus being capable of playing the strengthening role, enhancing the bearing capacity, reducing material and processing requirements and improving the overall structural firmness.

Figure 17:
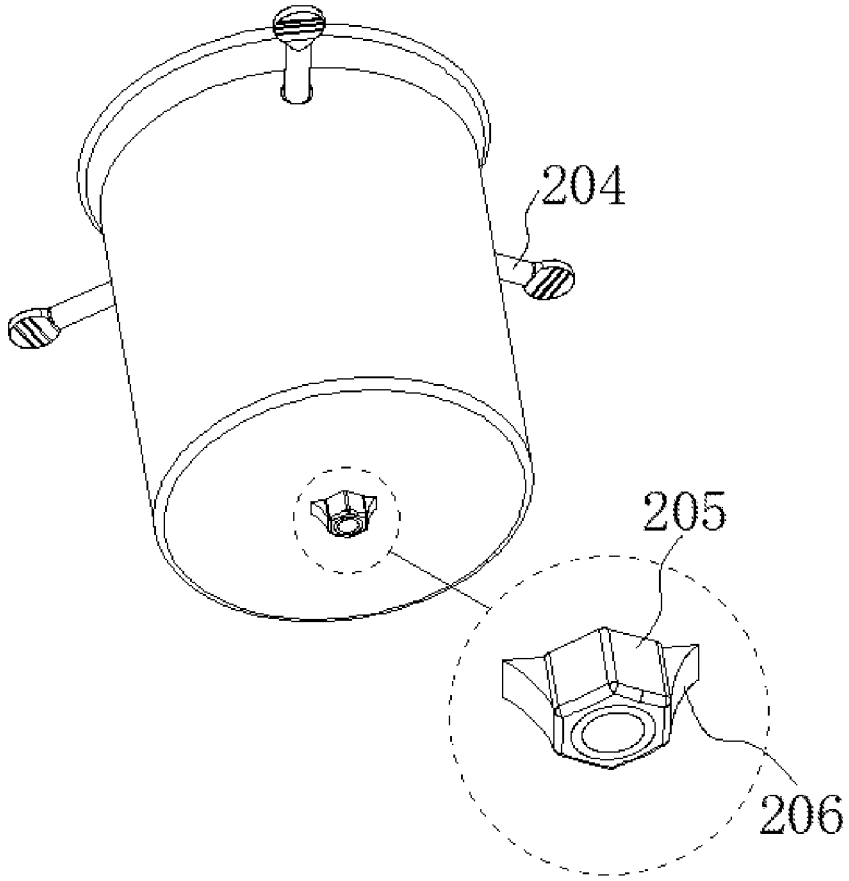
FIG. 17 is a schematic structural view of a connector in the embodiment of FIG. 1 and a partially schematic enlarged view thereof.

As shown in FIG. 17, a first nut 205 is welded on a bottom surface of the first bearing cylinder 201 for fit with the fastener 105 to fixedly connect the first bearing cylinder 201 with the tree stand support assembly 100. Both sides of the first nut 205 are respectively formed with a welding portion 206 for welding it to the bottom surface of the first bearing cylinder 201, and the other position sides of the first nut 205 do not have the welding portion 206.

Figure 9:
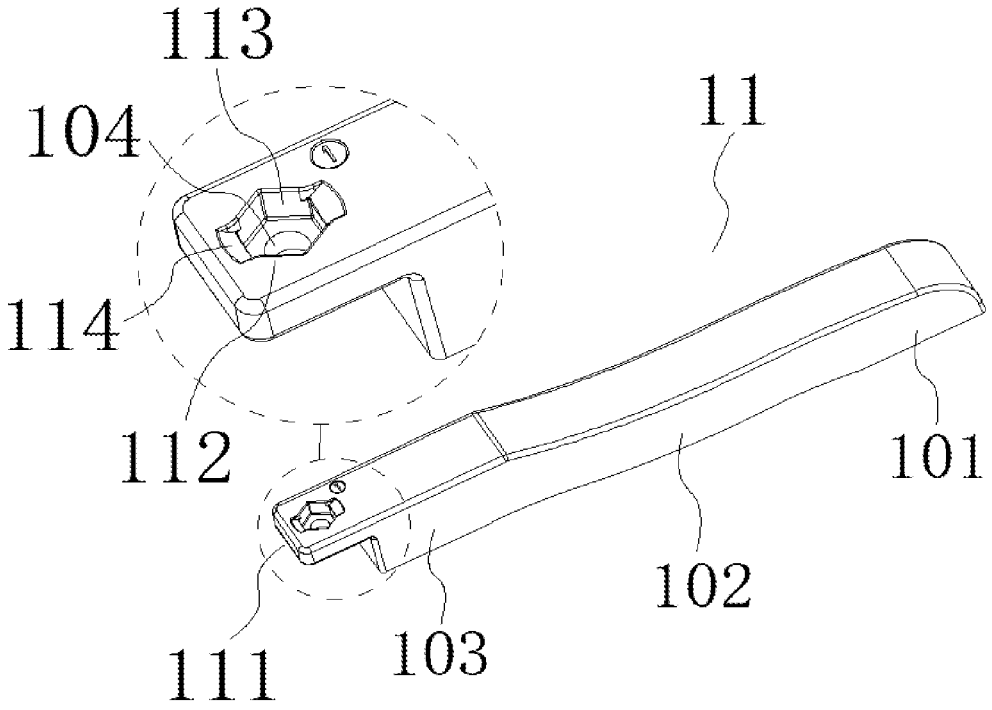
FIG. 9 is a schematic structural top view of a first tree stand member in FIG. 3 and a partially schematic enlarged view thereof.
Figure 10:
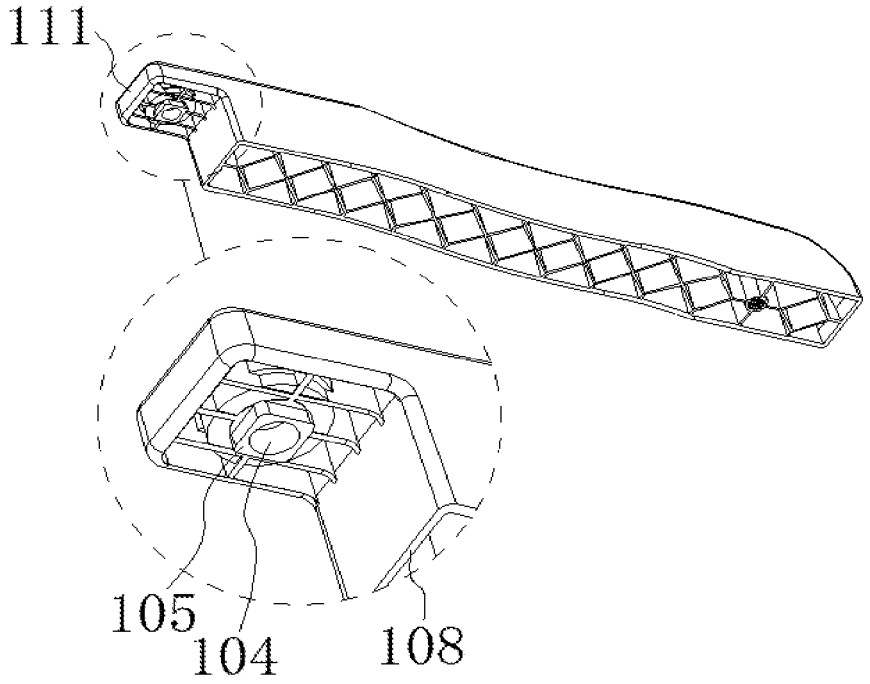
FIG. 10 is a schematic structural bottom view of FIG. 9 and a partially schematic enlarged view thereof.
Figure 11:
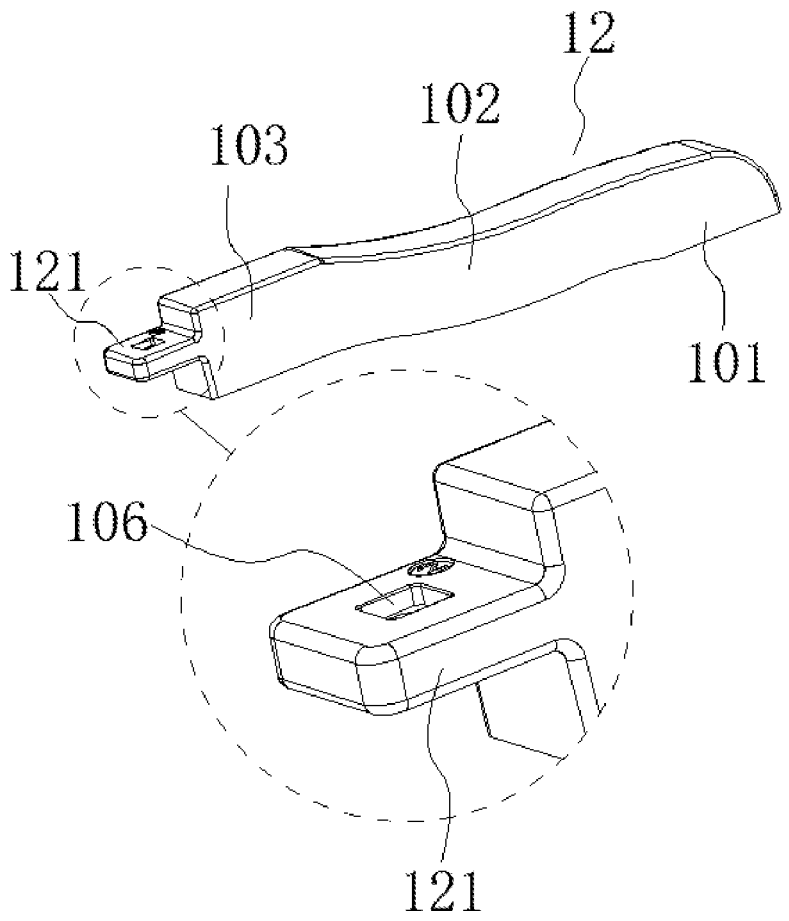
FIG. 11 is a schematic structural top view of a second tree stand member in FIG. 3 and a partially schematic enlarged view.
Figure 12:
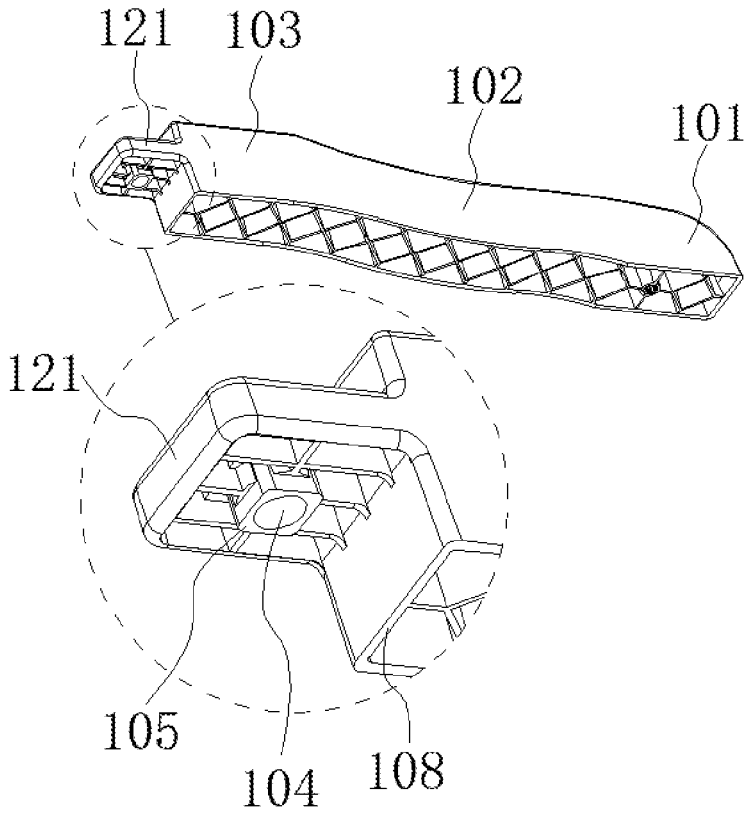
FIG. 12 is a schematic structural bottom view of FIG. 11 and a partially schematic enlarged view thereof.
Figure 13:
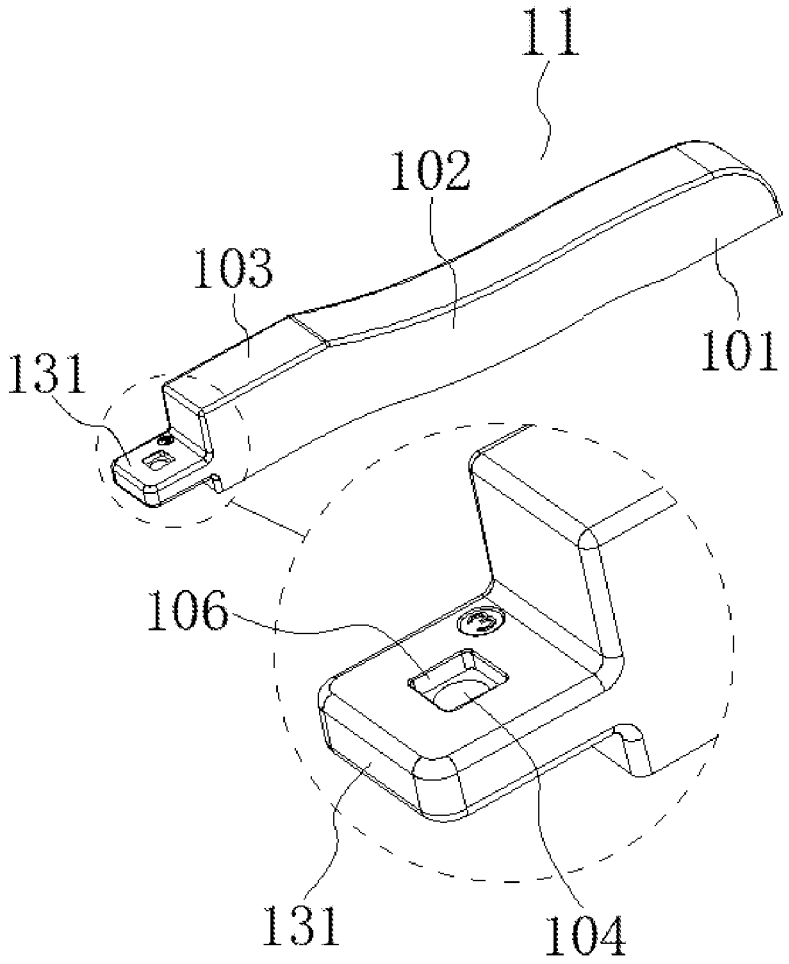
FIG. 13 is a schematic structural top view of a third tree stand member in FIG. 3 and a partially schematic enlarged view thereof.
Figure 14:
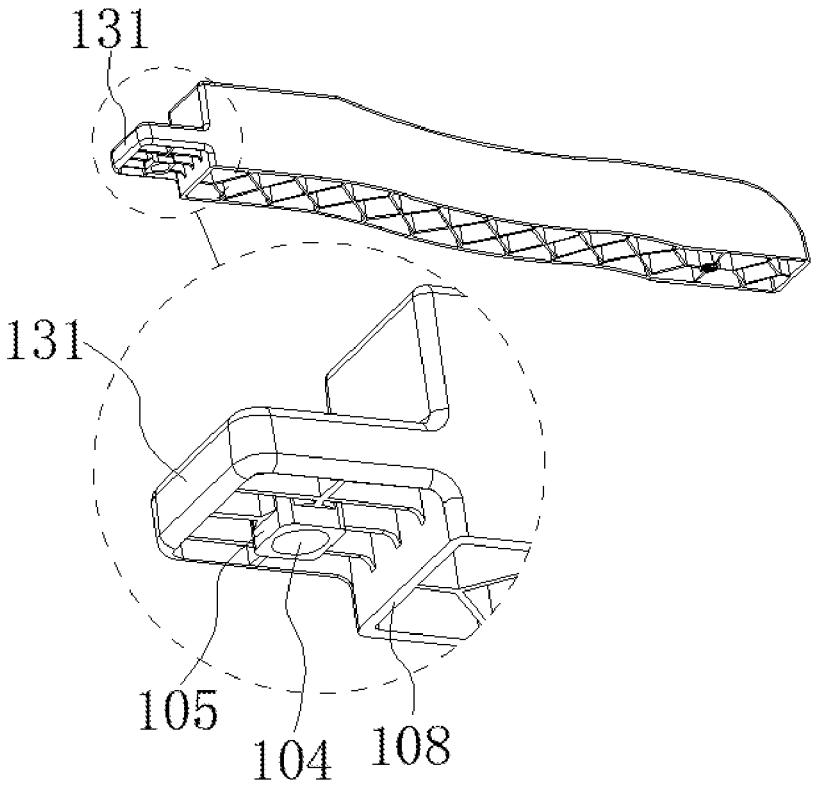
FIG. 14 is a schematic structural bottom view of FIG. 13 and a partially schematic enlarged view thereof.

As shown in FIG. 9, the first assembly portion 111 located on an uppermost layer is concavely provided with a nut concave position 112, and the nut concave position 112 comprises a nut cavity 113 and secondary cavities 114 located on two sides thereof, the nut cavity 113 is configured to accommodate and position a first thread 205, and the secondary cavities 114 are configured to provide the welding portion 206, so that a rotation limiting structure is provided between the tree stand support assembly 100 and the first bearing cylinder 201 so as to facilitate the assembly of the fastener 15.

For the Christmas tree stand of this embodiment, the tree stand members are structurally decomposed so that the tree stand members have a short length to facilitate packaging and transportation. In addition, an assembly process thereof is more simple and convenient, and after the tree stand members 10 are assembled in sequence to form an assembly structure capable of fixing themselves, they are fixed to the bottom surface of the first bearing cylinder 201 by the fastener 15.

Embodiment 2

Figure 18:
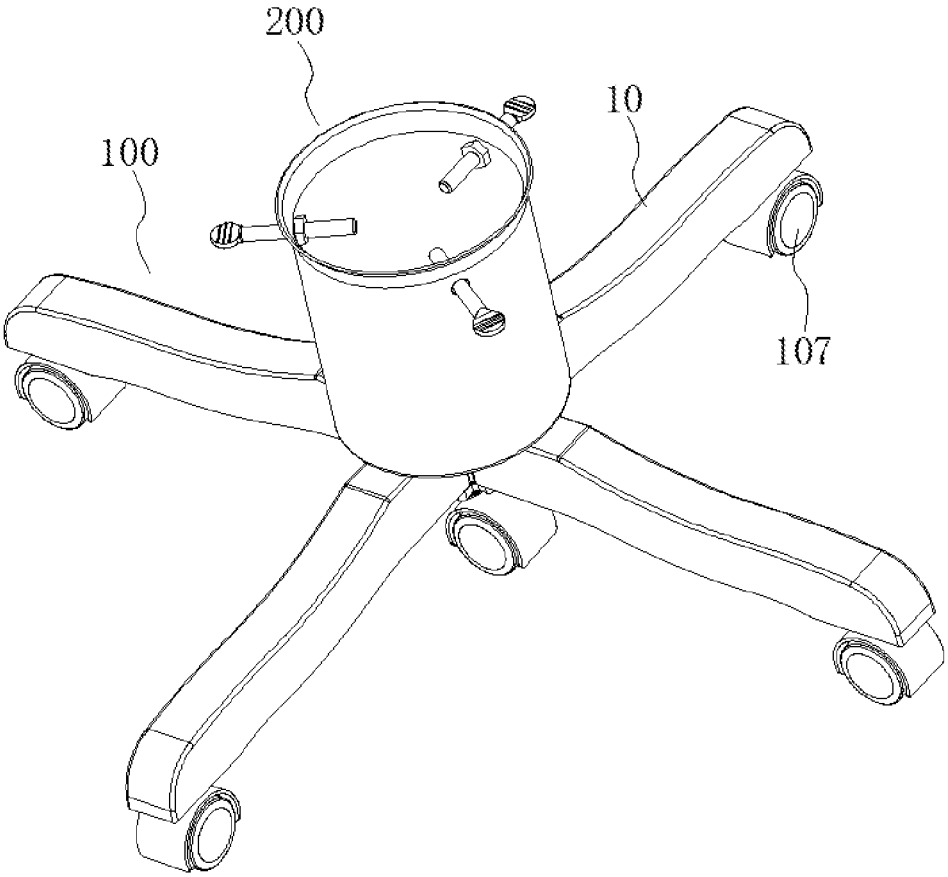
FIG. 18 is a schematic structural view of a Christmas tree stand according to Embodiment 2 of the disclosure, to which moving wheels added with respect to Embodiment 1.

As shown in FIG. 18, a cross Christmas tree stand has a same main structure as that of Embodiment 1, and differs in that the Christmas tree stand of the embodiment further comprises moving wheels 107, with one moving wheel 107 respectively provided at the outer end of each tree stand member 10 and at the center of the tree stand support assembly 100.

Here, the moving wheel 107 and a wheel lock structure are known, and reference can be made to moving wheels in the field of furniture, which will not be described in detail herein. Furthermore, whether the moving wheel 107 has a locking structure is not limited.

Embodiment 3

Figure 19:
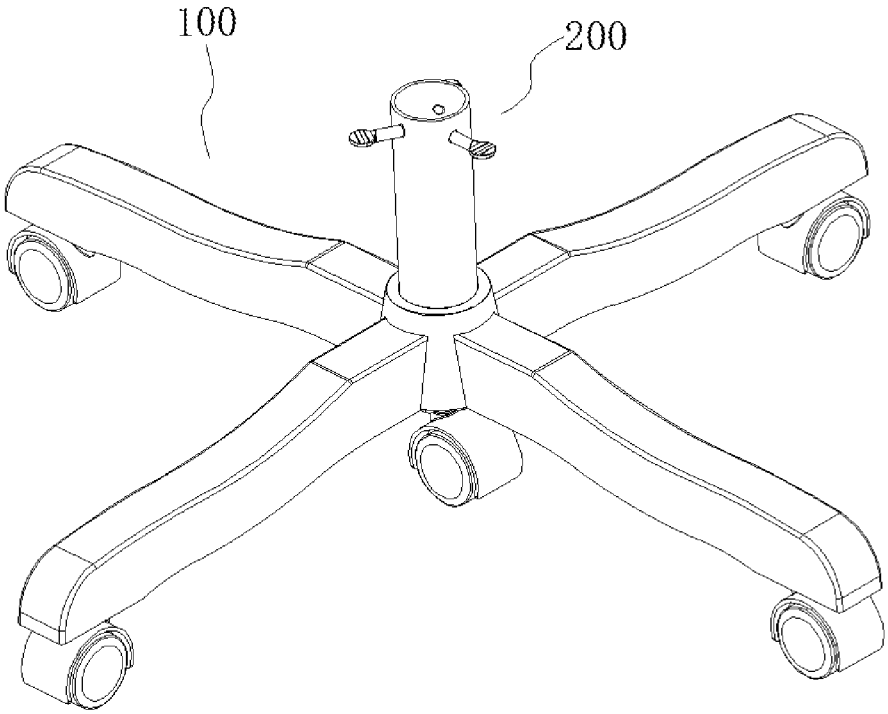
FIG. 19 is a schematic structural view of a Christmas tree stand according to Embodiment 3 of the disclosure.
Figure 20:
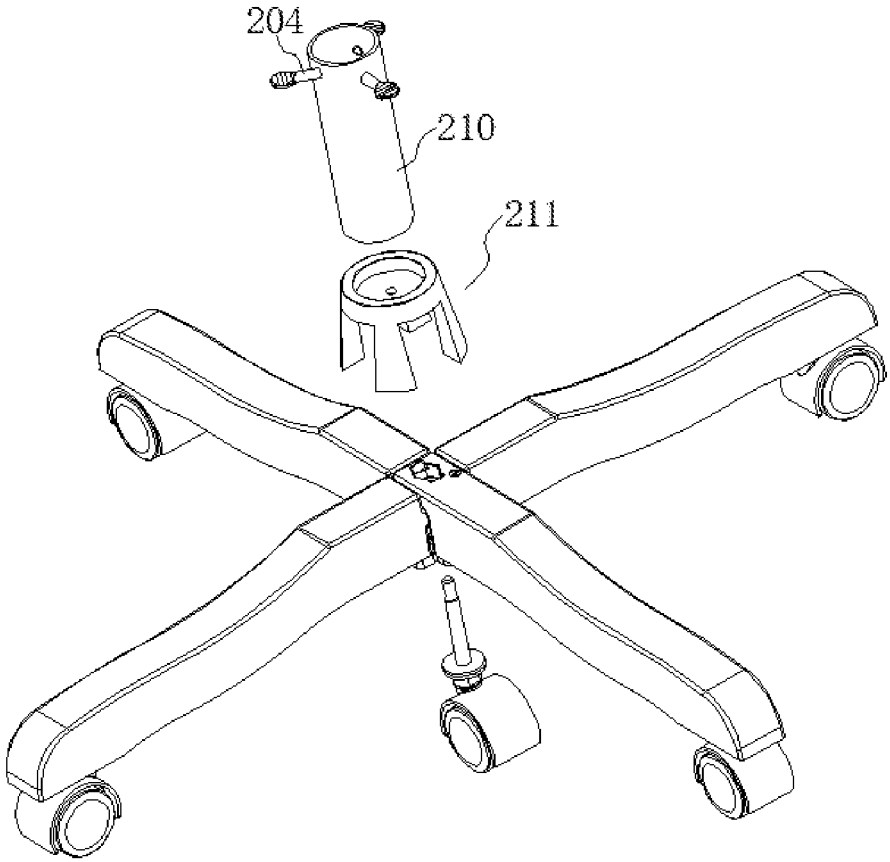
FIG. 20 is a structural exploded view of FIG. 19.

As shown in FIGS. 19 and 20, a Christmas tree stand has a same main as that of Embodiment 1 or Embodiment 2, and differs in that a connector 200 of the embodiment is different from that of Embodiment 1, and the tree stand support assemblies 100 of both embodiments are the same.

Unlike Embodiment 1 which is mainly applied to a real Christmas tree, the Christmas tree stand of the Embodiment is mainly adapted to an artificial Christmas tree.

In the Embodiment, the connector 200 comprises a second bearing cylinder 210 and a covering member 211, the second bearing cylinder 210 is made of a metal tube, a bottom sheet is welded to a bottom surface thereof, a threaded hole is provided on the bottom surface for a fastener 15 to fit, and the fastener 15 passes through the tree stand members 10 in turn and fits in the threaded hole, so that the second bearing cylinder 210 is fixedly fixed to the tree stand support assembly 100. The covering member 211 is placed between the second bearing cylinder 210 and the tree stand support assembly 100, and is provided with a through hole or a threaded hole for the fastener 15 to pass through. The covering member 211 is mainly configured for decoration, and covers junctions of the tree stand members 10.

In the Embodiment, since weight of an artificial tree is much lighter than that of a real tree, and fixing strength of the artificial tree is reduced accordingly, an adjusting member 204 of the Embodiment can be fitted into the threaded hole provided on the second bearing cylinder 210 and having an internal thread on an internal wall thereof by means of an external thread on an outer surface thereof, without welding a second nut 203 as in Embodiment 1.

Embodiment 4

An assembled support assembly has a structure similar to the tree stand support assembly 100 in Embodiment 1, is formed by assembling four tree stand members 10 to each other, and the tree stand members 10 are assembled to each other by corresponding assembly portions 111, 121, 131 and 141, respectively, as shown in FIGS. 3 and 8-15. The difference is that, in the embodiment, a gap between a second support portion 109 at a central position of the tree stand support assembly 100 and a support surface (e.g., the ground) is not limited to 0.2-2 cm. That is, in the Embodiment, a bottom surface of the tree stand support assembly 100 may be horizontal, or only a number of peripheral first support portions 101 may be in contact with the support surface such as the ground to provide a support force, and the second support portion 109 may not be in contact with the support surface at all times (regardless of whether the Christmas tree is erected or not). Of course, it is also possible to have the second support portion 109 in contact with the support surface to bear the force after the erection of the Christmas tree as in Embodiment 1.

In other embodiments, the number of the tree stand members 10 may be 3, 5, 6 or more.

The assembled support assembly may be applied to a Christmas tree stand for support, or to other load-bearing components for support, such as being fixed to a bottom of a flowerpot body for support.

Embodiment 5

A Christmas tree stand comprises the tree stand support assembly 100 of Embodiment 4 and a connector 200.

Here, the structure of the connector 200 is the same as or similar to that of Embodiment 1 or 3, as shown with reference to FIGS. 1-2 and 17-20.

In this embodiment, the tree stand support assembly 100 does not have moving wheels 107. In other embodiments, the tree stand support assembly 100 may also have moving wheels 107, as described with reference to Embodiment 2.

The tree stand support assemblies of Embodiments 4 and 5 together with the Christmas tree stand have the following beneficial effects:

1. The tree stand support assembly is formed by assembling, which can reduce product volume in the process of packaging and transportation, and is beneficial to reducing the cost.
2. The assembly process is convenient and the structure is firm after assembly.
3. The tree stand support assembly can be adapted to real trees and artificial trees by using different connectors, which can improve the versatility of parts and enrich the diversity of products.
4. The tree stand support assembly can be shaped after self-assembly to form a pre-assembly body with preliminary self-retention, and the tree stand members 10, after assembly, can form a pre-assembly body which cannot easily fall off as shown in FIG. 3, so that it can be conveniently taken, moved and assembled during subsequent assembly, facilitating the operation.

What is claimed is:

1. A Christmas tree stand, comprising:

a tree stand support assembly, the tree stand support assembly comprising at least three tree stand members, each of the tree stand members comprising a tree stand member outer end and a tree stand member inner end, and the tree stand members being assembled with each other at the tree stand member inner ends to form the tree stand support assembly; and a connector fixed to the tree stand support assembly for bearing a Christmas tree;

wherein an assembly portion is provided at the tree stand member inner end of the tree stand member, a first rotation limiting member and a second rotation limiting member are respectively provided on the assembly portions of adjacent tree stand members, and the assembly portions of adjacent tree stand members fit with each other by the first rotation limiting member and the second rotation limiting member to limit relative rotation between the two tree stand members; an upper and lower limiting mechanism is also respectively provided between two adjacent tree stand members or between one tree stand member and the other tree stand members, the upper and lower limiting mechanism comprises a first limiting member and a second limiting member, and the first limiting member and the second limiting member are in interference fit or snap-fitted with each other to limit the tree stand members in an up and down direction so that the tree stand members are assembled and shaped.

2. The Christmas tree stand according to claim 1, wherein the first rotation limiting member and the second rotation limiting member are respectively provided at an upper surface and a lower surface of the assembly portion; the first rotation limiting member is a clamping convex which is convexly provided on the lower surface or the upper surface of the assembly portion, the second rotation limiting member is a clamping concave which is concavely provided on the upper surface or the lower surface of the assembly portion, and a cross sectional shape of the clamping convex and the clamping concave is a triangle, a quadrilateral, a pentagon or a hexagon so as to limit the relative rotation of the adjacent tree stand members after the clamping convex and the clamping concave fit with each other.

3. The Christmas tree stand according to claim 2, wherein the assembly portions have a same thickness and are respectively provided at a corresponding height position on the corresponding tree stand member, and a sum of the thickness of the assembly portions is equal to a height of the tree stand member after assembly;

the upper and lower limiting mechanism is realized by interference fit between the clamping convex and the clamping concave; and the number of the tree stand members is 3, 4, 5 or 6, the tree stand members are uniformly arranged along a circumferential direction, and the assembly portions of the tree stand members are sequentially arranged from top to bottom.

4. The Christmas tree stand according to claim 1, wherein the upper and lower limiting mechanism comprises a first snap connection portion and a second snap connection portion which are respectively provided on different tree stand members, and the first snap connection portion and the second snap connection portion are in interference fit or snap-fitted with each other to perform upper and lower limiting fixation between two adjacent tree stand members or between one tree stand member and the other tree stand members.

5. The Christmas tree stand according to claim 4, wherein an outside of the assembly portion of one tree stand member is formed with a clamping portion, the first snap connection portion is arranged on the clamping portion, and the second snap connection portion is arranged on a bottom surface of the tree stand member inner end of the other tree stand member; the tree stand member inner end is disposed on the clamping portion such that both the tree stand member outer end and the tree stand member inner end are in contact with a support surface to provide a support force.

6. The Christmas tree stand according to claim 5, wherein each of the assembly portions is further provided with a through hole, and a fastener passes through the through holes of the tree stand members in turn to fix the tree stand support assembly.

7. The Christmas tree stand according to claim 6, wherein the connector comprises a first bearing cylinder, an interior of the first bearing cylinder is hollow so as to form a bearing cavity for accommodating the Christmas tree, a number of through holes are provided at an upper portion of the bearing cavity, a second nut is welded on an inner wall at the through holes, and an adjusting member is in thread fit with the second nut; or the connector comprises a second bearing cylinder and a covering member, the covering member is arranged between the second bearing cylinder and the tree stand support assembly, and the fastener passes through the tree stand members and the covering member in turn and is connected to the second bearing cylinder.

8. The Christmas tree stand according to claim 6, wherein the tree stand support assembly is provided with a plurality of moving wheels, and the moving wheels are provided at an outer end of each of the tree stand members and at a center of the tree stand support assembly.

9. A Christmas tree stand, comprising:

a tree stand support assembly, the tree stand support assembly comprising at least two support members, the support members crossing each other at a middle portion to form the tree stand support assembly; and a connector fixed to the tree stand support assembly for bearing a Christmas tree;

wherein the support members are respectively formed by assembling two tree stand members with each other at an intersection point, each of the tree stand member comprises a tree stand member outer end and a tree stand member inner end, and the tree stand members are assembled with each other at the tree stand member inner ends to form the tree stand support assembly; an assembly portion is provided at the tree stand member inner end of the tree stand member, the assembly portion is provided with a through hole, and the assembly portions of the tree stand members are sequentially arranged from top to bottom and are passed through by a fastener so as to fix the tree stand support assembly to the connector; and a second support portion is formed at an intersection of the support members, the second support portion is formed on the assembly portion or the fastener on a bottom layer, and a first support portion is formed on at least one of the support members and outside the intersection; in an initial condition, the first support portion is in contact with a support surface to bear a force, and the second support portion is suspended and not in contact with the support surface; and after the Christmas tree is fixed into the connector, the second support portion is in contact with the support surface to bear a force, and the second support portion bears a greater force than the first support portion.

10. The Christmas tree stand according to claim 9, where the first support portion is formed at an outer end of each of the tree stand members, and a gap between the second support portion and the support surface is 0.2-2 cm.

11. The Christmas tree stand according to claim 10, wherein the assembly portion is provided with a first rotation limiting member or a second rotation limiting member, and the assembly portions of adjacent tree stands fit with each other by the first rotation limiting member and the second rotation limiting member to limit relative rotation between the two tree stand members; and the first rotation limiting member and the second rotation limiting member are respectively provided at an upper surface and a lower surface of the assembly portion; and an upper and lower limiting mechanism is also respectively provided between two adjacent tree stand members or between one tree stand member and the other tree stand members, the upper and lower limiting mechanism comprises a first limiting member and a second limiting member, and the first limiting member and the second limiting member are in interference fit or snap-fitted with each other to limit the tree stand members in an up and down direction so that the tree stand members are assembled and shaped.

12. The Christmas tree stand according to claim 11, wherein the first rotation limiting member is a clamping convex which is convexly provided on the lower surface or the upper surface of the assembly portion, the second rotation limiting member is a clamping concave which is concavely provided on the upper surface or the lower surface of the assembly portion, and a cross sectional shape of the clamping convex and the clamping concave is a triangle, a quadrilateral, a pentagon or a hexagon so as to limit the relative rotation of the adjacent tree stand members after the clamping convex and the clamping concave fit with each other; and the upper and lower limiting mechanism comprises a first snap connection portion and a second snap connection portion which are respectively provided on different tree stand members, and the first snap connection portion and the second snap connection portion are in interference fit or snap-fitted with each other to perform upper and lower limiting fixation between two adjacent tree stand members or between one tree stand member and the other tree stand members.

13. The Christmas tree stand according to claim 12, wherein an outside of the assembly portion of one tree stand member is formed with a clamping portion, the first snap connection portion is arranged on the clamping portion, and the second snap connection portion is arranged on a bottom surface of the tree stand member inner end of the other tree stand member; the tree stand member inner end is disposed on the clamping portion such that both the tree stand member outer end and the tree stand member inner end are in contact with the support surface to provide a support force.

14. The Christmas tree stand according to claim 11, wherein a first nut is welded on a bottom surface of a first bearing cylinder, and a welding portion for welding the first nut to the bottom surface of the first bearing cylinder is formed on an outside of the first nut;

a nut concave position is concavely provided on the upper surface of the assembly portion of the tree stand member on a top layer, the nut concave position comprises a nut cavity and secondary cavities located at two sides thereof, the nut cavity is used for accommodating and positioning a first thread, and the secondary cavities are used for providing the welding portion so as to form a rotation limiting structure between the tree stand support assembly and the first bearing cylinder;

the assembly portions have a same thickness and are respectively provided at a corresponding height position on the corresponding tree stand member, and a sum of the thickness of the assembly portions is equal to a height of the tree stand member after assembly;

the upper and lower limiting mechanism is realized by interference fit between the clamping convex and the clamping concave;

the number of the tree stand members is 3, 4, 5 or 6, the tree stand members are uniformly arranged along a circumferential direction, and the assembly portions of the tree stand members are sequentially arranged from top to bottom;

the connector comprises a first bearing cylinder, an interior of the first bearing cylinder is hollow so as to form a bearing cavity for accommodating the Christmas tree, a number of through holes are provided at an upper portion of the bearing cavity, a second nut is welded on an inner wall at the through holes, and an adjusting member is in thread fit with the second nut; or the connector comprises a second bearing cylinder and a covering member, the covering member is arranged between the second bearing cylinder and the tree stand support assembly, and the fastener passes through the tree stand members and the covering member in turn and is connected to the second bearing cylinder; and the tree stand support assembly is provided with a plurality of moving wheels, and the moving wheels are provided at an outer end of each of the tree stand members and at a center of the tree stand support assembly.

15. An assembled support assembly, comprising at least three leg members, wherein each of the leg members comprises a tree stand member outer end and a leg member inner end, the leg members are assembled with each other at the leg member inner ends to form an assembled support assembly;

an assembly portion is provided at the leg member inner end of each of the leg members, the assembly portions of adjacent leg members are respectively provided with a first rotation limiting member and a second rotation limiting member, and the assembly portions of adjacent leg members fit with each other by the first rotation limiting member and the second rotation limiting member to limit relative rotation between the two leg members; and an upper and lower limiting mechanism is also respectively provided between two adjacent leg members or between one leg member and the other leg members, the upper and lower limiting mechanism comprises a first limiting member and a second limiting member, and the first limiting member and the second limiting member are in interference fit or snap-fitted with each other to limit the leg members in an up and down direction so that the leg members are assembled and shaped.

16. The assembled support assembly according to claim 15, wherein the first rotation limiting member and the second rotation limiting member are respectively provided at an upper surface and a lower surface of the assembly portion; and the first rotation limiting member is a clamping convex which is convexly provided on the lower surface or the upper surface of the assembly portion, the second rotation limiting member is a clamping concave which is concavely provided on the upper surface or the lower surface of the assembly portion, and a cross sectional shape of the clamping convex and the clamping concave is a triangle, a quadrilateral, a pentagon or a hexagon so as to limit the relative rotation of the adjacent leg members after the clamping convex and the clamping concave fit with each other.

17. The assembled support assembly according to claim 16, wherein the assembly portions have a same thickness and are respectively provided at a corresponding height position on the corresponding leg member, and a sum of the thickness of the assembly portions is equal to a height of the leg member after assembly;

the upper and lower limiting mechanism is realized by interference fit between the clamping convex and the clamping concave; and the number of the leg members is 3, 4, 5 or 6, the leg members are uniformly arranged along a circumferential direction, and the assembly portions of the leg members are sequentially arranged from top to bottom.

18. The assembled support assembly according to claim 16, wherein the upper and lower limiting mechanism comprises a first snap connection portion and a second snap connection portion which are respectively provided on different leg members, and the first snap connection portion and the second snap connection portion are in interference fit or snap-fitted with each other to perform upper and lower limiting fixation between two adjacent leg members or between one leg member and the other leg members.

19. The assembled support assembly according to claim 18, wherein an outside of the assembly portion of one leg member is formed with a clamping portion, the first snap connection portion is arranged on the clamping portion, and the second snap connection portion is arranged on a bottom surface of the leg member inner end of the other leg member; the leg member inner end is disposed on the clamping portion such that both the leg member outer end and the leg member inner end are in contact with a support surface to provide a support force.

20. The assembled support assembly according to claim 19, wherein each of the assembly portions is further provided with a through hole, and a fastener passes through the through holes of the leg members in turn to fix the leg support assembly.

* * * * *